US007757401B2

(12) United States Patent
Richard et al.

(10) Patent No.: US 7,757,401 B2
(45) Date of Patent: Jul. 20, 2010

(54) METHOD FOR MANUFACTURING A SCREEN FOR DOWNHOLE USE

(75) Inventors: Bennett M. Richard, Kingwood, TX (US); John T. Broome, The Woodlands, TX (US); Kendall Dyson, St. Martinville, LA (US); Matt Falgout, Kaplan, LA (US); Don Simoneaux, Washington, LA (US)

(73) Assignee: Baker Hughes Incorporated, Houston, TX (US)

( * ) Notice: Subject to any disclaimer, the term of this patent is extended or adjusted under 35 U.S.C. 154(b) by 1489 days.

(21) Appl. No.: 10/695,205

(22) Filed: Oct. 28, 2003

(65) Prior Publication Data

US 2005/0086807 A1 Apr. 28, 2005

(51) Int. Cl.
*B23P 11/00* (2006.01)
*E03B 3/18* (2006.01)

(52) U.S. Cl. ..... 29/896.62; 29/458; 29/505; 29/507; 403/277; 166/227

(58) Field of Classification Search ..... 29/896.6, 29/896.62, 447, 458, 507, 508, 516, 517, 29/521, 525, 525.14, 505; 403/273, 277, 403/285; 72/62, 370.06, 370.25; 166/227, 166/228, 236, 230, 231, 233; 210/459
See application file for complete search history.

(56) References Cited

U.S. PATENT DOCUMENTS 1,500,828 A * 7/1924 Layne ..... 166/236
1,854,517 A * 4/1932 Layne ..... 166/236
3,361,203 A 1/1968 Rensvold
3,378,420 A 4/1968 Dickinson et al.
3,885,298 A * 5/1975 Pogonowski ..... 29/507
3,908,256 A 9/1975 Smith, III
3,958,634 A 5/1976 Smith, III
4,284,138 A 8/1981 Allred
4,428,423 A 1/1984 Koehler et al.
5,088,554 A 2/1992 Arterbury et al.
5,190,102 A * 3/1993 Arterbury et al. ..... 166/228
5,992,518 A 11/1999 Whitlock
6,305,468 B1 * 10/2001 Broome et al. ..... 166/233
6,478,092 B2 * 11/2002 Voll et al. ..... 166/378

(Continued)

FOREIGN PATENT DOCUMENTS

WO PCT/US01/27581 9/2001

OTHER PUBLICATIONS

Bercegeay, E. Paul, et al., "A One-Trip Gravel Packing System", SPE 4771, Feb. 1974, 12 pages.

(Continued)

*Primary Examiner*—Jermie E Cozart
(74) *Attorney, Agent, or Firm*—Steve Rosenblatt

(57) ABSTRACT

An assembly method for a downhole screen is disclosed. In the preferred embodiment, the filtration layer is slipped over a perforated base pipe and an expansion technique is used to increase the base pipe diameter to the point where, preferably, an interference fit exists. The expansion can be fully underneath the filtration layer or can be done in discrete zones. The finished assembly can still be expanded further downhole, such as, for example, in open hole completions. An outer protective shroud can be employed over the filtration layer when the expansion of the base pipe occurs.

13 Claims, 2 Drawing Sheets

Expansion of base pipe with cone

Screen assembly after base pipe expansion

U.S. PATENT DOCUMENTS

| | | | | |
|---|---|---|---|---|
| 6,698,076 | B2 * | 3/2004 | Brissette et al. | 29/421.1 |
| 6,941,652 | B2 * | 9/2005 | Echols et al. | 29/896.62 |
| 7,077,196 | B2 * | 7/2006 | Rudd | 166/207 |
| 2004/0003927 | A1 * | 1/2004 | Rudd | 166/382 |

OTHER PUBLICATIONS

Underdown, David R., "Design and Implementation of Retention/Filtration Media for Sand Control", SPE 103782, Dec. 2006, Jan. 2008, 235-241.

Echols, Ralph, "Development and Testing of an Expandable Sand Screen and Expansion Tool", SPE 73750, Feb. 2002, 1-15.

Mathis, Stephen P., "Sand Management: A Review of Approaches and Concerns", SPE 82240, May 2003, 1-7.

Furui, K, et al., "Optimization of Horizontal Well-Completion Design With Cased/Perforated or Slotted Line Completions", SPE 90579, Sep. 2004, Oct. 2006, 248-253.

* cited by examiner

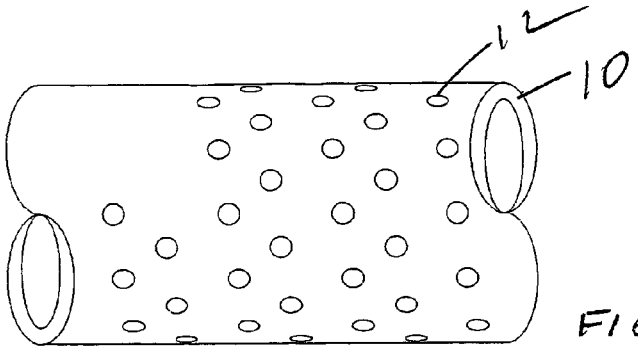
FIG#1
Base Pipe
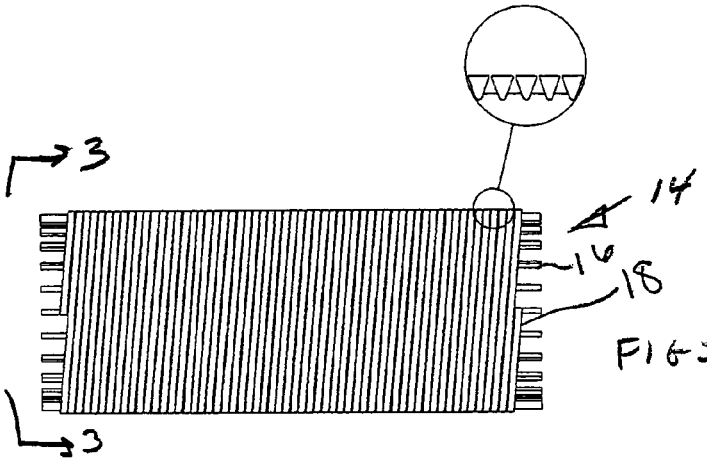
FIG#2
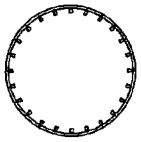
FIG#3
Wire Wrap Jacket
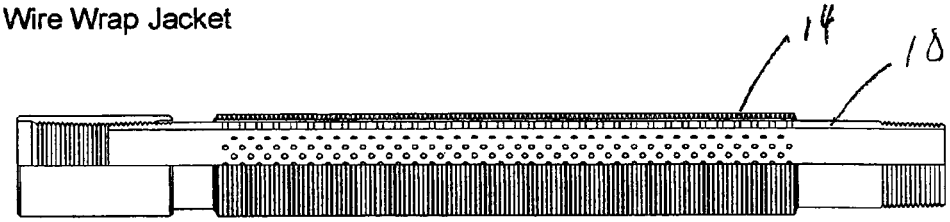
FIG#5
Screen assembly after base pipe expansion
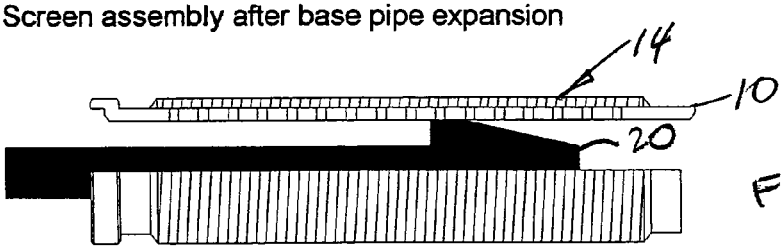
FIG#4
Expansion of base pipe with cone

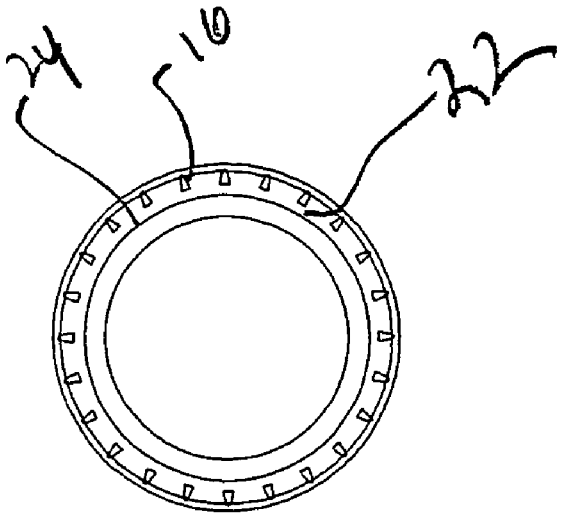
Before base pipe expansion
FIG#6
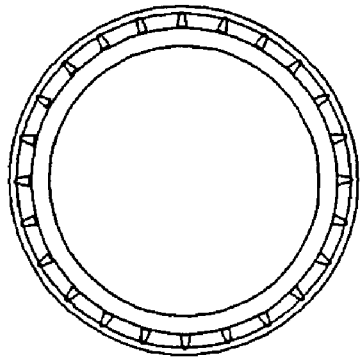
After base pipe expansion
FIG#7
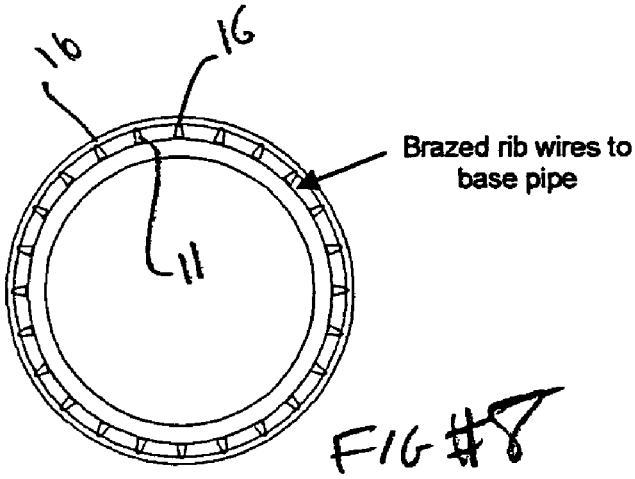
FIG#8

METHOD FOR MANUFACTURING A SCREEN FOR DOWNHOLE USE

FIELD OF THE INVENTION

The field of the invention is a method of manufacturing screen assemblies for downhole use and more particularly a method involving expansion of the base pipe to attach the filtration material to it.

BACKGROUND OF THE INVENTION

Screen used downhole typically involved welding the screen material to a base pipe at opposed ends to retain the layers together. Typical of such assembly techniques are U.S. Pat. Nos. 3,908,256; 3,958,634; 4,284,138 and 4,428,423. There are drawbacks to the welding technique of attaching a filter layer to a base pipe below it. One hazard is that the weld or welds could give out under conditions creating stress between the base pipe and the filtration layer. The base pipe could be in tension to such an extent from forces applied to it from above or from weight of tools and pipe hanging below that a weld failure could occur. When exotic materials are used there are added risks of corrosion at the welds to the base pipe. Since the filtration layer could become obstructed in use, concerns of collapse resistance of the filtration layer could arise in that the only secure connection to the base pipe is at the welds on either end of the filtration layer. Differential pressures on the filtration layer, particularly when partially fouled could lead to weld failure and a bypassing of the filtration layer.

In the past, techniques for manufacturing screens for downhole use have involved formation of overlapping layers of filtration material into a tube shape and forcing the concentric layers through a die to get them joined to each other without resort to welding a layer to the nest or welding seams in each layer. This technique is illustrated in U.S. Pat. No. 5,611,399. In other applications downhole screens that were made using the welding technique to attach a filter layer to a base pipe were run in the well and expanded for open hole completions.

The present invention employs a technique of slipping the filtration layer over the base pipe and then expanding the base pipe to get a preferably interference fit with the base pipe, thereby avoiding welding in the assembly process. Different types of filtration layers are envisioned. The expansion can be over the length of the base pipe that underlays the filtration layer or even just in discrete areas of the base pipe to secure the filtration layer. These and other advantages of the present invention will be more apparent to those skilled in the art from a review of the description of the preferred embodiment, the drawings and the claims, which all appear below.

SUMMARY OF THE INVENTION

An assembly method for a downhole screen is disclosed. In the preferred embodiment, the filtration layer is slipped over a perforated base pipe and an expansion technique is used to increase the base pipe diameter to the point where, preferably, an interference fit exists. The expansion can be fully underneath the filtration layer or can be done in discrete zones. The finished assembly can still be expanded further downhole, such as, for example, in open hole completions. An outer protective shroud can be employed over the filtration layer when the expansion of the base pipe occurs.

DETAILED DESCRIPTION OF THE DRAWINGS

FIG. 1 illustrates a perforated base pipe;

FIG. 2 illustrates a wire wrapped filtration layer before it is slipped over the base pipe;

FIG. 3 is an end view along lines 3-3 of FIG. 2;

FIG. 4 shows the expansion of the base pipe in progress;

FIG. 5 is the complete screen assembly after expansion of the base pipe;

FIG. 6 is a section through the assembly before expansion of the base pipe;

FIG. 7 is a section through the assembly after expansion of the base pipe;

FIG. 8 shows an alternative method using rods brazed to the base pipe that secure the filter layer upon heating from within the base pipe.

DETAILED DESCRIPTION OF THE PREFERRED EMBODIMENT

Referring to FIG. 1 a base pipe 10 has multiple openings 12 that can be of any shape and in any pattern and made in a variety of different ways that are known in the art. A filter layer 14 can have a variety of configurations. In FIG. 2 it is shown to have a cylindrical shape obtained by a series of ribs 16 that are held in a cylindrical shape by a wound wire 18 of preferably triangular cross-section. The depicted spiral wound wire screen, shown in FIG. 2, is of a type known in the art. Other filter layers can be used that are, for example, a weave of wires into a cylindrical shape having one or more layers and having a desired opening size or prepacks made from any variety of materials including sintered beads.

The preferred method of securing the filter layer 14 to the base pipe 10 is shown in FIGS. 4-7. In FIG. 4 the filter layer has been slipped over the base pipe 10 and the expansion of the base pipe 10 has begun with a schematically depicted swage 20 that represent any one of a number of ways to expand a pipe. In the preferred embodiment, an interference fit is obtained by expansion of base pipe 10. While the full length of the base pipe 10 under the filter assembly can be expanded with swage 20, the invention encompasses expanding base pipe 10 in selected zones, such as at the ends of the filter layer 14 or in other locations. The base pipe 10 can also be expanded for the entire length of the filter layer 14 and then extending beyond the ends on one or both ends. Preferably, an interference fit should be created from the expansion. The expansion may be continued downhole such as in open hole completions where the annular space around the screen is reduced or eliminated as an alternative to gravel packing.

As an alternative, the dimension of the filter layer 14 can be reduced once placed over the base pipe 10 or a combination of increasing the base pipe dimension while reducing the filter layer dimension is also contemplated. The filter layer 14 can be pre-expanded to allow insertion of the base pipe and then the filter layer can be allowed to retract elastically to a position where it is engaged to the base pipe, preferably with an interference fit.

FIG. 6 is a section view of the filter layer 14 over the base pipe 10 with a gap 22 between the outer surface 24 of the base pipe 10 and the ribs 16. In FIG. 7, it can be seen that the gap 22 has been closed due to expansion.

The advantage of the method of the present invention is to provide greater resistance of the filter layer 14 to tensile loads transmitted from the base pipe 10. There is greater collapse strength in the filter layer 14 because the interference fit between the filter layer 14 and the base pipe 10 provides firm support over as much as the entire length of the filter layer 14. With the need to weld, use adhesives or mechanical connectors eliminated, the screen can be made more cheaply and in some application the corrosion that could be an issue at the welds is eliminated.

FIG. 8 discloses an alternative method. Here the base pipe 10 has rods 11 secured to it in an offset pattern from the ribs 16. The rods 11 can be brazed to the base pipe 10. When the base pipe 10 is heated, preferably internally, the rods 11 attach to the filter layer 14, without the need for expansion of the base pipe 10. Alternatively, the base pipe 10 can be coated with a brazing material. The filter layer is slipped over the base pipe 10 and heat is applied until the brazing material acts to adhere the filter layer 14 to the base pipe 10. Thus, the coating of the brazing material can be used instead of the brazed rib wires to get the same result of attachment due to applied heat to the assembly either from within or from outside the base pipe 10.

The foregoing disclosure and description of the invention are illustrative and explanatory thereof, and various changes in the size, shape and materials, as well as in the details of the illustrated construction, may be made without departing from the invention.

We claim:

1. A method of manufacturing a screen prior to subterranean use, comprising:

inserting a base pipe into a filter layer;

securing said filter layer to said base pipe by expanding said base pipe until said base pipe contacts said filter layer to fix said filter layer against translation with respect to said base pipe such that welding is not necessary and thus completing the manufacturing of the screen before its subterranean deployment.

2. The method of claim 1, comprising:

creating an interference fit between said base pipe and said filter layer.

3. The method of claim 2, comprising:

accomplishing said securing said filter layer to said base pipe without welding, adhesives or mechanical connectors.

4. The method of claim 1, comprising:

reducing the size of said filter layer.

5. The method of claim 1, comprising:

inserting said base pipe and filter layer downhole;

expanding said base pipe downhole.

6. The method of claim 1, comprising:

mounting a protective jacket to said filter layer before inserting said base pipe.

7. The method of claim 1, comprising:

creating an interference fit between said base pipe and said filter layer as said base pipe is expanded;

inserting downhole said base pipe and filter layer already secured to said base pipe;

expanding said base pipe downhole.

8. The method of claim 7, comprising:

mounting a protective jacket to said filter layer before or after inserting said base pipe.

9. The method of claim 1, comprising:

expanding said base pipe for at least a portion of the length of said filter layer.

10. The method of claim 9, comprising:

expanding said base pipe near the ends of said filter layer.

11. The method of claim 9, comprising:

expanding said base pipe for the entire length of said filter layer and beyond.

12. A method of manufacturing a screen for downhole use, comprising:

inserting a base pipe into a filter layer;

applying a material to the base pipe to contact said filter layer;

applying heat to said base pipe to allow said material to secure the filter layer to the base pipe;

using a series of substantially parallel ribs to form the filter layer;

using a series of ribs on said base pipe positioned in an offset manner from said ribs of said filter layer to allow said filter layer to be slipped over said base pipe;

using said ribs on said base pipe to retain said filter layer.

13. A method of manufacturing a screen for downhole use, comprising:

inserting a base pipe into a filter layer;

applying a material to the base pipe to contact said filter layer before said inserting;

applying heat to said base pipe after said inserting to allow said material to secure the filter layer to the base pipe;

using a coating on the outer surface of said base pipe as the material applied to the base pipe;

securing the filter layer to said base pipe with said coating.

* * * * *